United States Patent [19]

Nakane

[11] 4,391,060

[45] Jul. 5, 1983

[54] TOY ROBOT VEHICLE ASSEMBLY

[75] Inventor: Shigeru Nakane, Yachiyo, Japan

[73] Assignee: Takara Co., Ltd., Osaka, Japan

[21] Appl. No.: 294,894

[22] Filed: Aug. 21, 1981

[51] Int. Cl.[3] ..... A63H 33/00

[52] U.S. Cl. ..... 46/22; 46/17; 46/201

[58] Field of Search ..... 46/22, 202, 201, 17, 46/116, 115, 16, 124

[56] References Cited

U.S. PATENT DOCUMENTS

| | | | |
|---|---|---|---|
| 3,961,440 | 6/1976 | Saito . | |
| 4,038,775 | 8/1977 | Sato . | |
| 4,051,624 | 10/1977 | Ogawa | 46/202 |
| 4,183,173 | 1/1980 | Ogawa | 46/22 X |
| 4,206,564 | 6/1980 | Ogawa . | |
| 4,214,402 | 7/1980 | Ogawa | 46/201 X |
| 4,248,006 | 2/1981 | Jones et al. | 46/202 X |
| 4,307,533 | 12/1981 | Sims et al. | 46/22 |

*Primary Examiner*—Mickey Yu

*Attorney, Agent, or Firm*—Jackson, Jones & Price

[57] ABSTRACT

The present invention includes three vehicles that can operate independently as toys or alternatively can be reconfigured to simulate a robot.

11 Claims, 7 Drawing Figures

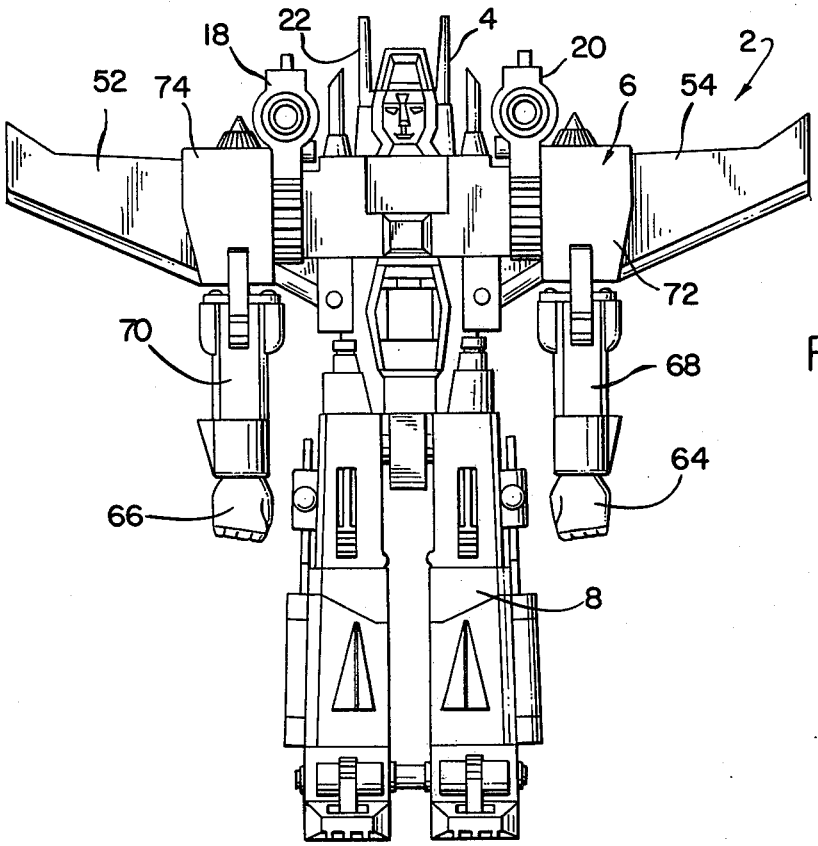
FIG. 1
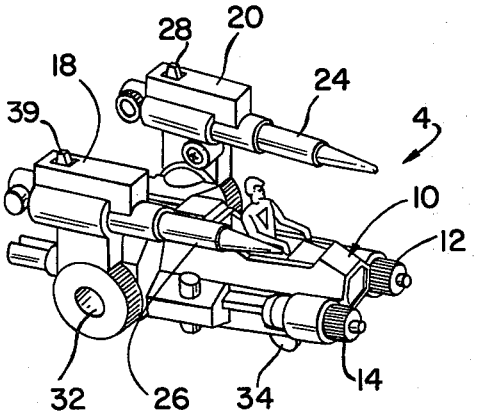
FIG. 2
FIG. 3
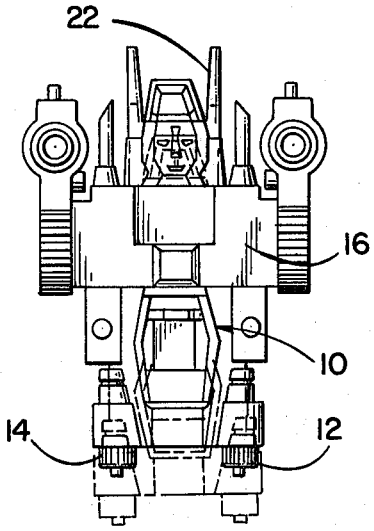

TOY ROBOT VEHICLE ASSEMBLY

BACKGROUND OF THE INVENTION

1. Field of the Invention

This invention relates to a toy robot doll and, more particularly, to a robot doll that is a composite of a plurality of individual toy components that are individually capable of creating separate toy vehicles.

2. Description of the Prior Art

Toy robot dolls having removable appendages, such as head, upper and lower limbs, are well-known in the toy field. The capability of reconfiguring various appendages and body parts into separate toys have been suggested and utilized successfully. Examples of such toys can be found in U.S. Pat. No. 3,961,440, U.S. Pat. No. 4,038,775 and U.S. Pat. No. 4,206,564. The latter patent is of particular interest in that it discloses a robot doll whose appendages and body member could be reconfigured to provide various forms of vehicles and sub-robot dolls.

Due to the inherent nature of the toy market, the toy industry is constantly striving to provide toys of unique and useful features which challenge the creative imagination and manual dexterity of children. The toy robot vehicle assembly of the present invention is a result of an effort to provide a toy having such unique and useful features.

SUMMARY OF THE INVENTION

The present invention is directed to futuristic space and robotic toys having a plurality of play options available for the child. When each of the individual toy component parts are assembled, the present invention simulates a robot with humanoid characteristics. Three component parts are provided, each with locomotion in the form of sets of wheels on each individual component part. Additionally, frictional fitting studs and apertures can be utilized to permit a removable connection of the individual component parts. The upper, or first, component part is configured to simulate a robotic head and upper trunk. When used as an individual toy, the robotic head can be retracted into the body of the trunk to enhance the simulation of a futuristic vehicle toy. In this regard, the adornment of the robotic head is complementary to an exhaust tube of a rocket engine and thereby enhances the rocket effect.

A second component part is configured to simulate a pair of robotic arm appendages and further includes wings that can be relatively expanded. Individual projectile firing mechanisms are provided on each wing and are relatively movable apart from a central body member which simulates a fuselage of a plane.

A third component part is configured to simulate a pair of robotic leg appendages. This component part mounts two pivotal support members that can simulate either a pair of feet for the robotic configuration or rocket engines.

The object and features of the present invention which are believed to be novel are set forth with particularity in the appended claims. The present invention, both as to its organization and manner of operation, together with further objects and advantages thereof, may best be understood be reference to the following description, taken in connection with the accompanying drawings.

BRIEF DESCRIPTION OF THE DRAWINGS

FIG. 1 is a front view of the toy assembly in the configuration of a robot toy;

FIG. 2 is a perspective view of a first component part;

FIG. 3 is a plan view of the first component part;

DESCRIPTION OF THE PREFERRED EMBODIMENTS

Figure 4:
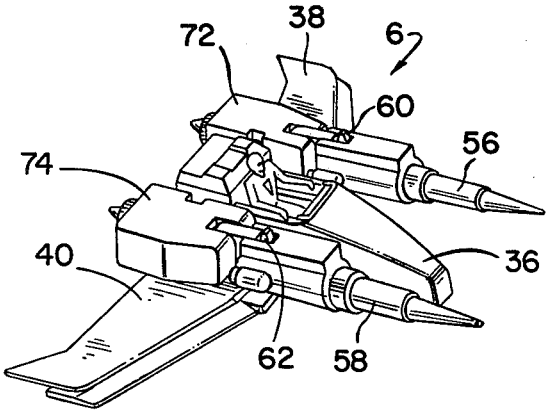
FIG. 4 is a perspective view of a second component part.
Figure 5:
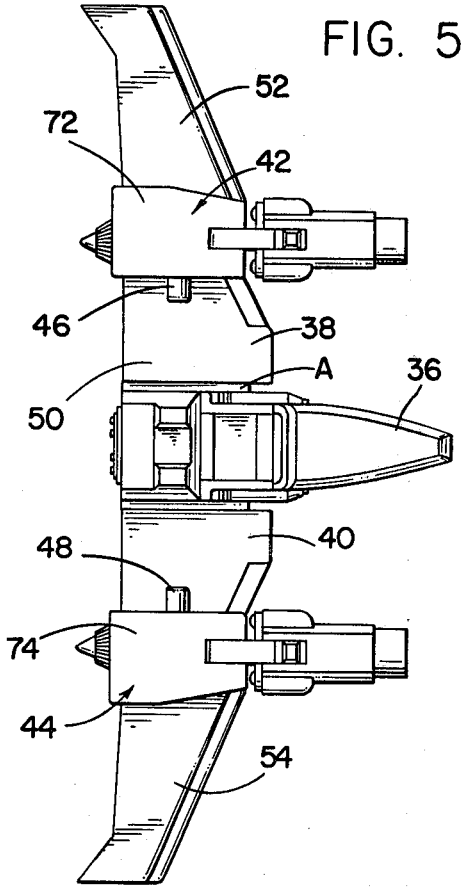
FIG. 5 is a plan view of a second component part.

The following description is provided to enable any person skilled in the toy industry to make and use the invention and sets forth the best modes contemplated by the inventor of carrying out his invention. Various modifications, however, will remain readily apparent to those skilled in the toy industry, since the generic principles of the present invenion have been defined herein specifically to provide a relatively economical and easily manufactured toy robot assembly formed of individual component parts that can provide separate vehicle toys.

Referring to FIG. 1, a front view of the composite robot toy 2 of the present invention is disclosed. The robot toy 2 can be subdivided into three separate component parts or members consisting of a first member 4 which can simulate a robotic head and upper trunk body; a second member 6 which can simulate the arm appendages of a robotic figure; and a third member 8 which can simulate the legs and feet appendages of a robotic member.

Referring to FIG. 2, a perspective view of the first member 4 is disclosed in a vehicle configuration. A fuselage or vehicle body 10 includes an operator control seat and a pair of serrated mounting plugs 12 and 14. Enclosing the body 10 is a shroud member 16 that pivotally supports a pair of firing mechanisms 18 and 20 that are appendaged on either side of the shroud member 16. The fuselage member 10 is movable for a limited travel through the shroud member 16 as can be seen from FIG. 3. The purpose of this limited travel is to permit the head portion 22 to be partially obscured by movement into the shroud member 16 so that the head ornament resembles the exhaust of a rocket engine.

The respective firing mechanisms 18 and 20 are capable of firing missiles 24 and 26 by activation of the firing levers 28 and 39, respectively. The specific construction of the firing mechanisms are conventional and can be of the type disclosed in U.S. Pat. No. 4,206,564, which is incorporated by reference to supplement the present specification. An aperture on either side of the shroud member, such as the female aperture 32 disclosed in FIG. 2, provides means for interconnection by a friction fitting with a male post member on another component part.

Finally, wheels such as element 34 are conventionally provided on the bottom surface of the first member 4 to permit locomotion on a support surface. These wheels, like the wheels on the second and third component members, will be mounted on the back of the robot of FIG. 1 when assembled together as an operative whole.

Referring to FIG. 4, a perspective view of the second component member 6 is disclosed in an embodiment of a rocket plane vehicle. A fuselage body 36 again provides an operator cockpit and is attached to a pair of wings 38 and 40. These respective wing members are actually extendable and permit a pair of firing mechanisms 42 and 44 to be connected to or separated from the fuselage body member 36. Female apertures (not shown) on either side of the fuselage body member are designed to provide a friction fit with a pair of male mounting posts 46 and 48 on the respective firing mechanisms. The fuselage member is pivotally connected to the respective wing members 38 and 40 at point A to permit the fuselage member 36 to rotate 180° to lie flush with the underside of the respective wing members 38 and 40.

The central support wing member 50 also carries, on its undercarriage, a pair of wheels that complement a wheel positioned, but not seen in the drawings, on the underside of the nose of the fuselage member 36. Transverse-slotted apertures (not shown) are provided extending outward on each side of the central support wing member 50 and receive retention pins (not shown) which extend down from the respective wing tip portions 52 and 54 and lock the respective wing tip portions to the central support wing member but permit a sliding outward and inward movement. The support wing member 50 can also be molded to provide a recessed or elongated aperture to receive the wheels of the first member 4 when it is interconnected with the second member 6. In this regard, the interconnection is achieved by inserting the mounting posts 46 and 48 into the respective female apertures on the first member 4. Likewise, the mounting posts 46 and 48 can be secured directly to the apertures (not shown) on either side of the fuselage body 36 to maintain a stable configuration of an individual toy component shown in FIG. 4.

The firing mechanisms 42 and 44 are capable of firing simulated missiles 56 and 58 and are of a standard configuration with firing levers 60 and 62. Referring to FIG. 1, it can be seen that the firing missiles can also be a simulated configuration of a robotic fist 64 and 66 and can, of course, be fired in the same mode of operation as the more conventional missiles 56 and 58. The forward portions 68 and 70 of the respective firing mechanisms 42 and 44 can have the configuration of forearms of a robotic figure and are further pivoted or articulatedly jointed to the rear portion 72 and 74 to permit subjective alignment to further provide a realistic simulation of a robotic figure.

Figure 6:
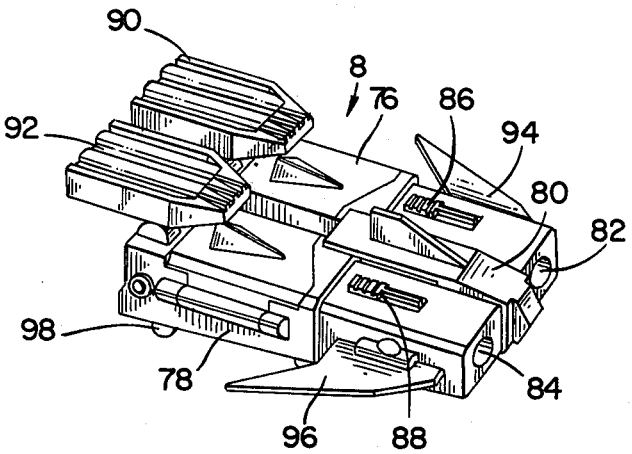
FIG. 6 is a perspective view of a third component part.
Figure 7:
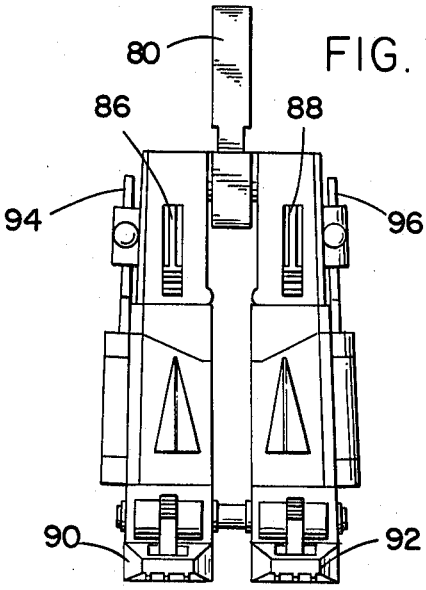
FIG. 7 is a plan view of the third component part.

Referring to FIG. 6, a perspective view of the third component 8 of the present invention is disclosed in a vehicle mode of operation. A pair of leg appendages of a robotic configuration are parallel aligned as element 76 and 78. A pivotal support member 80 can overlie the respective leg appendages as shown in FIG. 6 to help simulate the front fuselage of a rocket plane vehicle. As shown in FIG. 7, this support member 80 can also be extended upward for mounting behind the first member 4 when the first member's mounting plugs 12 and 14 are appropriately fitted within the female apertures 82 and 84. The support member 80 serves the function of extending beneath the inverted fuselage 36 and stabilizing it on the rear surface of the robotic figure.

The female apertures 82 and 84 serve a secondary function in that they are tubes for missiles (not shown) that can be fired by activation of the firing levers 86 and 88, respectively, in the conventional manner described previously. At the base of each leg aperture 76 and 78, support members 90 and 92 are pivotally mounted. In the position shown in FIG. 6, the support members are designed to simulate rocket engines. In the position shown in FIG. 7, the support members are designed to simulate and provide functional feet support for the robot toy assembly 2. Optional wing members 94 and 96 are pivotally mounted to the sides of each of the leg apertures to complete the rocket plane configuration. Four wheels 98 are provided at the bottom surface of the third member 8 to permit locomotion as an independent toy on a support surface.

In operation, the child can take the first component member 4 and force the fuselage 10 backward to expose the head portion 22 of the robotic figure. The seconc component member 6, while in the vehicle form shown in FIG. 4, will have the individual firing mechanisms 42 and 44 traversely moved from the fuselage body 36 to release the respective mounting posts 46 and 48 from their female apertures. The fuselage body 36 is then rotated 180° behind the central support wing member 50. The first component member 4 is then aligned so that its apertures, such as 32, are juxtapositioned relative to the mounting posts 46 and 48. The firing mechanisms are then slid together to effectuate a frictional coupling with the first component member 4. The missiles 56 and 58 can be replaced with appropriate missiles 66 and 64 that simulate robotic fists.

The third component member 8 is then reconfigured to rotate the support member 80 to an extended position. The support members 90 and 92 are also rotated from a position in which they simulate rocket engines to a foot support position. The mounting posts 12 and 14 are then slid respectively into the female apertures 82 and 84 with the rear support post 80 extending behind the first component member 4 and underneath the fuselage member 36 to stabilize its position on the rear surface of the robotic toy assembly. The respective firing mechanisms 18 and 20 can then be rotated 90° to assume the position shown in FIG. 1 while the forward portions 68 and 70 of the firing mechanisms 42 and 44 are susceptible to a subjective positioning at the desire of the child to create a life-like configuration.

Finally, a wing portions 94 and 96 can optionally be positioned adjacent the leg appendages or extended out into wing configurations which, in the overall format of the robot toy assembly, does not detract from the robotic configuration but simply highlights the futuristic impression to the child.

The above description describes the preferred embodiments of the present invention, however persons of ordinary skill in the toy field are capable of numerous modifications once taught these principles.

Accordingly, the present invention should be determined solely from the following claims, wherein I claim:

1. A toy assembly simulating a robot of humanoid form with removable members reconfigurable into separate toy vehicles comprising:

a first member configured to simulate a robotic humanoid head and trunk;

a second member removably attached to the first member and configured to simulate a pair of robotic humanoid arm appendages;

a third member removably attached to the first member and configured to simulate a pair of robotic humanoid leg appendages;

means on the first member for removable connection to the second and third members, and means for providing locomotion on each of the first, second and third members to permit each member to operate independently as separate vehicles.

2. The invention of claim 1 wherein the second member includes simulated wings extending from a body member.

3. The invention of claim 2 further including means for firing a projectile on each wing.

4. The invention of claim 3 wherein the means for firing a projectile are relative movable outward from the body member.

5. The invention of claim 4 wherein means for interconnecting with the first member are provided on the wings.

6. The invention of claim 5 wherein each wing member is divided into two movable wing portions.

7. The invention of claim 5 further including projectiles configured to simulate humanoid hands.

8. The invention of claim 5 wherein the body member is pivotally connected to the wing members to permit rotation behind the wing members to accomodate interconnection with the first member when configured into a robot toy.

9. The invention of claim 1 wherein the third member includes a pair of support members pivotally connected to assume one position simulating the feet of a robot and a second position simulating a pair of rocket engines.

10. A toy assembly simulating a robot of humanoid form with removable members reconfigurable into separate toy vehicles comprising:

a first member configured to simulate a robotic humanoid head and trunk member;

a second member removably attached to the first member and configured to simulate a pair of robotic humanoid arm appendages;

a third member removably attached to the first member and configured to simulate a pair of robotic humanoid leg appendages;

means for providing locomotion on each of the first, second and third members to permit each member to operate independently as simulated vehicles; and means on the first member for connection to the second and third members, the robot head being relatively movable into the trunk member to permit reconfiguration into a simulated toy vehicle.

11. The invention of claim 10 wherein the robot head simulates a rocket exhaust assembly when moved into the trunk member.

* * * * *